US008925917B2

(12) United States Patent
Watanabe et al.

(10) Patent No.: US 8,925,917 B2
(45) Date of Patent: Jan. 6, 2015

(54) SHEET OUTPUT DEVICE, SHEET PROCESSING APPARATUS, IMAGE FORMING SYSTEM, AND SHEET OUTPUT METHOD

(71) Applicants: Takahiro Watanabe, Kanagawa (JP); Masahiro Tamura, Gifu (JP); Shuuya Nagasako, Kanagawa (JP); Tomohiro Furuhashi, Kanagawa (JP); Keisuke Sugiyama, Tokyo (JP); Kyosuke Nakada, Kanagawa (JP); Kazuya Yamamoto, Kanagawa (JP); Tomomichi Hoshino, Kanagawa (JP); Akira Kunieda, Tokyo (JP); Junya Suzuki, Kanagawa (JP); Kazunori Konno, Kanagawa (JP); Takamasa Matsumoto, Kanagawa (JP); Youhei Niitsuma, Kanagawa (JP); Kiichiro Goto, Kanagawa (JP)

(72) Inventors: Takahiro Watanabe, Kanagawa (JP); Masahiro Tamura, Gifu (JP); Shuuya Nagasako, Kanagawa (JP); Tomohiro Furuhashi, Kanagawa (JP); Keisuke Sugiyama, Tokyo (JP); Kyosuke Nakada, Kanagawa (JP); Kazuya Yamamoto, Kanagawa (JP); Tomomichi Hoshino, Kanagawa (JP); Akira Kunieda, Tokyo (JP); Junya Suzuki, Kanagawa (JP); Kazunori Konno, Kanagawa (JP); Takamasa Matsumoto, Kanagawa (JP); Youhei Niitsuma, Kanagawa (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/011,794

(22) Filed: Aug. 28, 2013

(65) Prior Publication Data

US 2014/0062016 A1 Mar. 6, 2014

(30) Foreign Application Priority Data

Aug. 31, 2012 (JP) ..... 2012-192351

(51) Int. Cl.

| | |
|---|---|
| ***B65H 29/00*** | (2006.01) |
| ***B65H 29/24*** | (2006.01) |
| ***G03G 15/00*** | (2006.01) |
| *G03G 21/20* | (2006.01) |

(52) U.S. Cl.

CPC ..... *B65H 29/00* (2013.01); *B65H 29/246* (2013.01); *B65H 2301/4461* (2013.01);

(Continued)

(58) Field of Classification Search

CPC ..... B65H 2515/212; B65H 29/24; B65H 29/245; B65H 29/246

USPC ..... 271/306, 309, 211, 189, 195, 3.07, 271/3.11; 399/92

See application file for complete search history.

(56) References Cited

U.S. PATENT DOCUMENTS 3,502,407 A * 3/1970 Ellis et al. ..... 399/335
4,036,087 A * 7/1977 Braun ..... 83/79

(Continued)

FOREIGN PATENT DOCUMENTS

JP 2011-057313 3/2011

*Primary Examiner* — Patrick Cicchino

(74) *Attorney, Agent, or Firm* — Harness, Dickey & Pierce, P.L.C.

(57) ABSTRACT

According to an embodiment, provided is a sheet output device including: a sheet output unit configured to output a sheet; a tray unit on which the sheet output by the sheet output unit is to be stacked; an air blower unit configured to blow air onto the sheet output by the sheet output unit; and a control unit configured to control an airflow rate of the air blower unit according to an amount of the sheet output from the sheet output unit.

11 Claims, 14 Drawing Sheets

(52) U.S. Cl.
CPC ..... *B65H 2406/122* (2013.01); *B65H 2511/10* (2013.01); *B65H 2511/13* (2013.01); *B65H 2511/416* (2013.01); *B65H 2513/512* (2013.01); *B65H 2513/514* (2013.01); *B65H 2515/212* (2013.01); *B65H 2801/27* (2013.01); *G03G 15/6511* (2013.01); *G03G 21/206* (2013.01)
USPC ..... 271/211; 271/309

(56) References Cited

U.S. PATENT DOCUMENTS 4,372,550 A * 2/1983 Woods ..... 271/211
4,405,125 A * 9/1983 Kulpa et al. ..... 271/195
5,133,542 A * 7/1992 von Kwiatkowski et al. 271/183
5,324,024 A * 6/1994 Mori ..... 271/296
5,460,361 A * 10/1995 Mokler ..... 271/183
6,522,841 B2 * 2/2003 Horikoshi ..... 399/45
6,962,334 B2 * 11/2005 Erkelenz ..... 271/183
7,283,776 B2 * 10/2007 Oba ..... 399/304
7,661,671 B2 * 2/2010 Yamazaki et al. ..... 271/211
7,941,088 B2 * 5/2011 Suzuki ..... 399/405
8,016,287 B2 * 9/2011 Watanabe ..... 271/209
8,682,240 B2 * 3/2014 Fukita et al. ..... 399/405
2006/0093420 A1 * 5/2006 Oba ..... 399/405
2006/0228139 A1 * 10/2006 Suzuki ..... 399/405
2009/0169224 A1 * 7/2009 Suzuki ..... 399/45
2010/0254721 A1 * 10/2010 Fukita et al. ..... 399/44
2011/0170883 A1 * 7/2011 Suzuki ..... 399/18
2012/0093555 A1 * 4/2012 Obuchi ..... 399/405
2013/0113154 A1 5/2013 Furuhashi et al.
2013/0134659 A1 5/2013 Konno et al.
2013/0147105 A1 6/2013 Sugiyama et al.

* cited by examiner

SHEET OUTPUT DEVICE, SHEET PROCESSING APPARATUS, IMAGE FORMING SYSTEM, AND SHEET OUTPUT METHOD

CROSS-REFERENCE TO RELATED APPLICATIONS

The present application claims priority to and incorporates by reference the entire contents of Japanese Patent Application No. 2012-192351 filed in Japan on Aug. 31, 2012.

BACKGROUND OF THE INVENTION

1. Field of the Invention

The present invention relates to a sheet output device, a sheet processing apparatus, an image forming system, and a sheet output method. More particularly, the invention relates to a sheet output device configured to receive a sheet-like recording medium (hereinafter referred to as a "sheet") conveyed thereto and send air to the sheet when outputting the sheet while aligning and stacking the sheet, a sheet processing apparatus that includes the sheet output device, an image forming system including the sheet processing apparatus and an image forming apparatus, and a sheet output method to be performed by the sheet output device. Examples of the sheet-like recording medium include a sheet of paper, recording paper, transfer paper, and OHP (overhead projector) sheet. Examples of the image forming apparatus include a copier, a printer, a facsimile, and a digital multifunction peripheral.

2. Description of the Related Art

Conventionally, sheet processing apparatuses that perform various processing, e.g., postprocessing such as alignment, stapling, folding, and bookbinding, on sheets output from an image forming apparatus are widely known and used. Hereinafter, such a sheet processing apparatus that performs postprocessing is referred to as a sheet postprocessing apparatus. In recent years, variety of sheets desired to be processed by this type of sheet postprocessing apparatus has become noticeably wide. In particular, it has become more common to perform printing using a color image forming apparatus on a sheet of coated paper (hereinafter, coated paper") that produces a visually-superior image for a brochure, a leaflet, or the like. Meanwhile, coated paper generally has the following properties:

1) high surface smoothness;

2) high inter-sheet clinging force; and 3) low stiffness measured using a Clark method.

These properties can make coated paper less favorable in terms of sheet stackability.

There are known techniques that, in view of such sheet stackability, form a layer of air using a fan so that an output sheet is stacked at a proper position. Known examples of such a technique include a technique disclosed in Japanese Laid-open Patent Publication No. 2011-057313. According to this technique, a sheet output device includes an output unit that outputs a sheet, on which an image is formed, in a sheet output direction and a tray unit that sequentially stacks thereon sheets output from the output unit. The sheet output device includes an air blowing mechanism capable of performing a series of operations on each sheet output from the output unit. The series of operations include blowing air onto a back-surface side of the sheet and stopping air blowing immediately before a trailing end of the sheet exits the output unit.

Such an air blowing mechanism as that disclosed in Japanese Laid-open Patent Publication No. 2011-057313 that blows air using, for example, a fan allows preventing buckling in a sheet conveying direction. However, it is difficult to attain favorable stacking reliably because, in a case where the output sheet is thin paper, the air blowing undesirably causes a leading end of the sheet to flutter.

There is a need for a sheet output device capable of preventing fluttering of a leading end of a sheet and achieving favorable alignment accuracy.

It is an object of the present invention to at least partially solve the problems in the conventional technology.

SUMMARY OF THE INVENTION

It is an object of the present invention to at least partially solve the problems in the conventional technology.

According to the present invention, there is provided: a sheet output device comprising: a sheet output unit configured to output a sheet; a tray unit on which the sheet output by the sheet output unit is to be stacked; an air blower unit configured to blow air onto the sheet output by the sheet output unit; and a control unit configured to control an airflow rate of the air blower unit according to an output sheet amount, the output sheet amount being an amount of the sheet output from the sheet output unit.

The present invention also provides a sheet processing apparatus comprising the above-mentioned sheet output device.

The present invention also provides an image forming system comprising the above-mentioned sheet output device.

The present invention also provides a sheet output method comprising: outputting, by a sheet output unit, a sheet conveyed to the sheet output unit; stacking the sheet output by the sheet output unit on a tray unit; and blowing air, by an air blower unit, the blowing air including starting air blowing, stopping the air blowing, and changing an airflow rate according to an amount of the sheet output from the sheet output unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to an aspect of the present invention, air is blown to a sheet being output onto a sheet output tray is performed as follows. That is, air blowing is performed each time a sheet is output and, moreover, an airflow rate is changed on a sheet-by-sheet basis so that fluttering of a sheet leading end is reduced and favorable sheet alignment accuracy is obtained. An exemplary embodiment of the present invention is described below with reference to the accompanying drawings.

Figure 1:
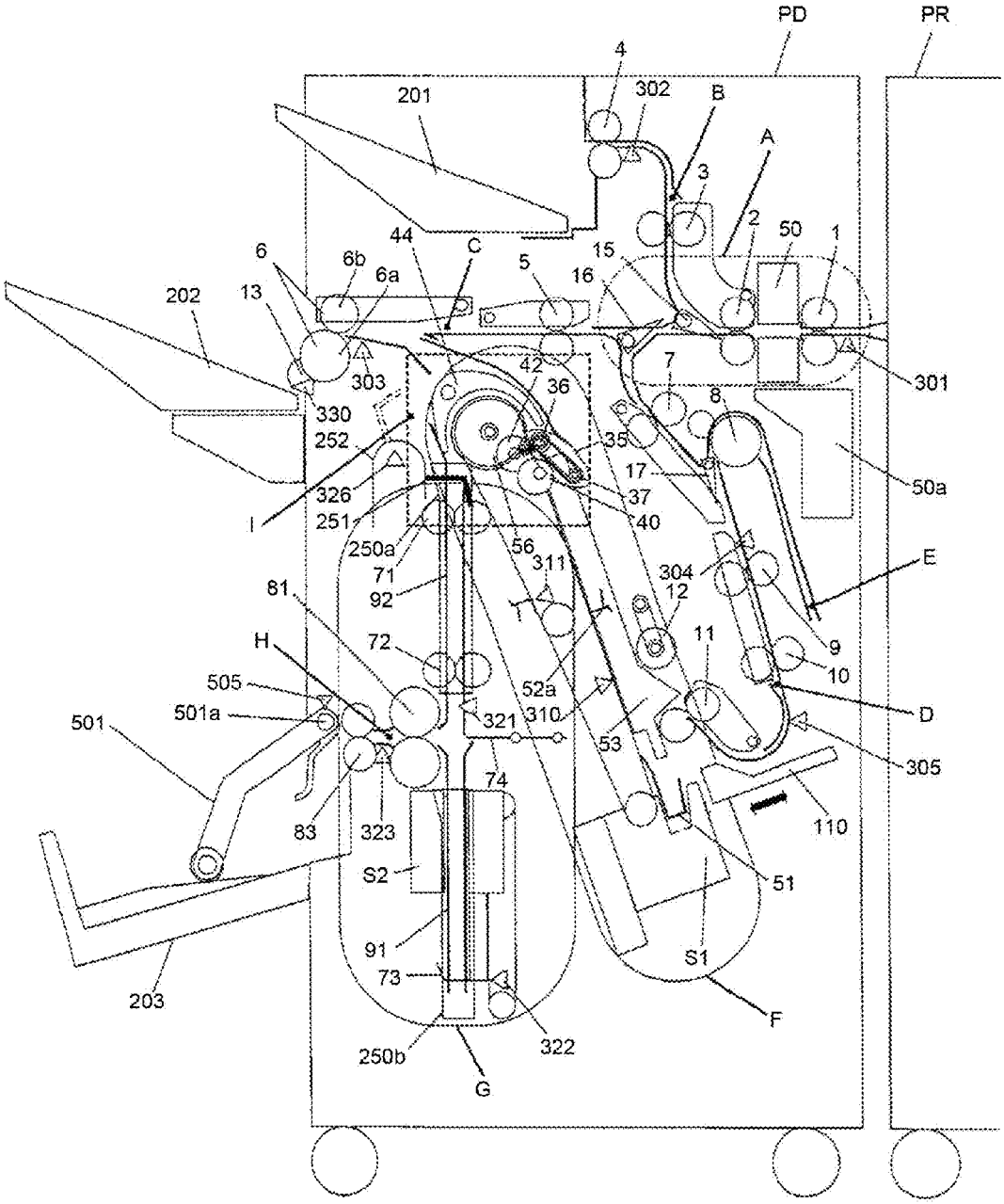
FIG. 1 is a system configuration diagram illustrating a system including an image forming apparatus and a sheet postprocessing apparatus, which is a sheet processing apparatus according to an embodiment of the present invention.

FIG. 1 is a system configuration diagram of an image forming system including an image forming apparatus PR and a sheet postprocessing apparatus PD, which is a sheet processing apparatus according to the present embodiment.

Referring to FIG. 1, the image forming apparatus PR includes an image processing circuit, an optical writing device, a developing device, a transfer device, and a fixing device. The image processing circuit converts image data input thereto into printable image data. The optical writing device forms a latent image on a photosensitive element by performing optical writing to the photosensitive element according to image signals output from the image processing circuit. The developing device develops the latent image formed on the photosensitive element with toner into a toner image. The transfer device transfers the toner image onto a sheet. The fixing device fixes the toner image onto the sheet. The image forming apparatus PR delivers the sheet, onto which the toner image is fixed, to the sheet postprocessing apparatus PD. The sheet postprocessing apparatus PD performs postprocessing as desired on the sheet. In the present embodiment, the image forming apparatus PR is an electrophotographic image forming apparatus as described above, but not limited thereto. Any known image forming apparatus, e.g., of an inkjet type or a thermal transfer type, can be used as the image forming apparatus PR. In the embodiment, the image processing circuit, the optical writing device, the development device, the transfer device, and the fixing device make up an image forming unit.

The sheet postprocessing apparatus PD is attached to a side of the image forming apparatus PR. A sheet that is output from the image forming apparatus PR is conveyed into the sheet postprocessing apparatus PD. The sheet postprocessing apparatus PD includes a conveying path A, a conveying path B, a conveying path C, a conveying path D, and a conveying path H. The sheet is first conveyed to the conveying path A that has a postprocessing unit (in the present embodiment, the postprocessing unit is a hole punch unit 50, which is a perforating unit) that performs postprocessing on a single sheet.

The conveying path B is a conveying path that extends from the conveying path A and leads to an upper tray 201. The conveying path C is the conveying path C that leads to a shift tray 202. The conveying path D is the conveying path D that leads to a processing tray F (hereinafter, also referred to as a "side-stitching tray") where alignment, stapling, and the like are performed. The conveying paths are configured such that a sheet conveyed to the conveying path A is then directed to one of the conveying paths B, C, and D by a route switch blade 15 and a route switch blade 16.

The sheet postprocessing apparatus can perform various sheet processing, such as hole punching (using the hole punch unit 50), sheet alignment and side stitching (using jogger fences 53 and a side-stitching stapler S1), sheet alignment and saddle stitching (using saddle-stitching upper jogger fences 250*a*, saddle-stitching lower jogger fences 250*b*, and a saddle-stitching stapler S2), sheet sorting (using the shift tray 202), and center folding (using a folding plate 74 and folding rollers 81). The conveying path A and one of the conveying paths B, C, and D extending from the conveying path A are selected according to processing to be performed. The conveying path D includes a sheet holding unit E. The side-stitching tray F, a saddle-stitching/center-folding tray G, and the sheet-output conveying path H are arranged downstream of the conveying path D.

The conveying path A is an upstream and common path of each of the conveyance paths B, C, and D. An entry sensor 301 that detects a sheet received from the image forming apparatus PR is arranged on the conveying path A. Arranged on the conveying path A downstream of the entry sensor 301 are entry rollers 1, the hole punch unit 50, a chad hopper 50*a*, conveying rollers 2, and the first and second route switch blades 15 and 16, in this order. The first and second route switch blades 15 and 16 are retained at orientations (in an initial state) illustrated in FIG. 1 by springs (not shown). When a first solenoid (not shown) and a second solenoid (not shown) are turned on, the route switch blade 15 and the route switch blade 16 are driven, respectively. By selecting on and off of the first and second solenoids, a combination of route-switch orientations of the first and second route switch blades 15 and 16 can be changed. The sheet is delivered to desired one of the conveying paths B, C, and D in this manner.

To convey the sheet to the conveying path B, the state illustrated in FIG. 1 is maintained, or, more specifically, the first solenoid is maintained in the off state (the first route switch blade 15 is oriented downward in the initial state). In this state, the sheet passes through conveying rollers 3 and then through upper sheet output rollers 4 to be output onto the upper tray 201.

To convey the sheet to the conveying path C, the first and second solenoids are turned on (the second route switch blade 16 is oriented upward in the initial state) from the state illustrated in FIG. 1 to put the route switch blade 15 and the route switch blade 16 in an upwardly pivoted state and a downwardly pivoted state, respectively. In this state, the sheet passes through conveying rollers 5 and then through pairs of sheet output rollers 6 (6*a* and 6*b*) to be conveyed toward the shift tray 202, where sheet sorting is performed. Sheet sorting is performed using the pairs of shift sheet-output rollers 6 (6*a* and 6*b*), a return roller 13, a sheet-level detection sensor 330, the shift tray 202, a shift mechanism that causes the shift tray 202 to reciprocate in a direction perpendicular to the sheet conveying direction, and a shift-tray elevating mechanism that moves up or down the shift tray 202.

To convey the sheet to the conveying path D, the first solenoid that drives the first route switch blade 15 is turned on and the second solenoid that drives the second route switch blade 16 is turned off, thereby putting both the first and second route switch blades 15 and 16 in the upwardly pivoted position. In this state, the sheet passes through the conveying rollers 2 and then through conveying rollers 7 to be conveyed to the conveying path D. The sheet conveyed to the conveying path D is further conveyed onto the side-stitching tray F. Sheets aligned and stapled on the side-stitching tray F are directed by a guide member 44 to one of the conveying path C that leads to the shift tray 202 and the saddle-stitching/center-folding tray G (hereinafter, also referred to as a "saddle stitching tray") where sheets undergo folding and the like. A sheet bundle PB that is to be conveyed to the shift tray 202 is output onto the shift tray 202 through the pairs of sheet output rollers 6. On the other hand, the sheet bundle PB that is conveyed to the saddle-stitching tray G is folded and stapled on the saddle-stitching tray G. The sheet bundle PB is conveyed along the sheet-output conveying path H to be output onto a lower tray 203 through lower sheet output rollers 83.

A route switch blade 17 is arranged on the conveyance path D and retained in a state illustrated in FIG. 1 by a low-load spring (not shown). After a trailing end of the sheet conveyed by the conveying rollers 7 has passed by the route switch blade 17, the sheet is conveyed backward along a turn guide 8 by rotating at least conveying rollers 9 from among the conveying rollers 9, conveying rollers 10, and sheet-stapling output rollers 11 in reverse. This configuration thus allows conveying the sheet to the sheet holding unit E where the sheet is temporarily held (pre-stacked) so that the sheet is overlaid by the next sheet and conveyed as a stack. It becomes possible to convey a stack of two or more sheets overlaid one another by repeating this operation. A pre-stack sensor 304 is used to set timing for backward feeding of the sheet to perform the pre-stacking.

When the sheet is to be conveyed to the conveying path D to be aligned and side-stitched, the sheet is conveyed by the sheet-stapling output rollers 11 onto the side-stitching tray F. Sheets are sequentially stacked on the side-stitching tray F. In this case, each time a sheet is stacked on the side-stitching tray F, the sheets are aligned in a longitudinal direction (sheet conveying direction) by a tapping roller 12 against trailing-end reference fences 51 and aligned in a lateral direction (direction perpendicular to the sheet conveying direction; also referred to as the "sheet width direction") against the jogger fences 53. The side-stitching stapler S1, which is a stapling unit, is driven to perform stapling in response to a stapling signal fed from a central processing unit (CPU) 101, which will be described later, in an interval between jobs, i.e., an interval between the last sheet of the sheet bundle PB and the first sheet of the next sheet bundle. Immediately after the stapling, the stapled sheet bundle PB is conveyed by an ejection belt 52 (see FIG. 2), from which ejection tabs 52*a* project, to the pairs of (shift) sheet output rollers 6, which in turn output the sheet bundle PB onto the shift tray 202 set at a receiving position.

Figure 2:
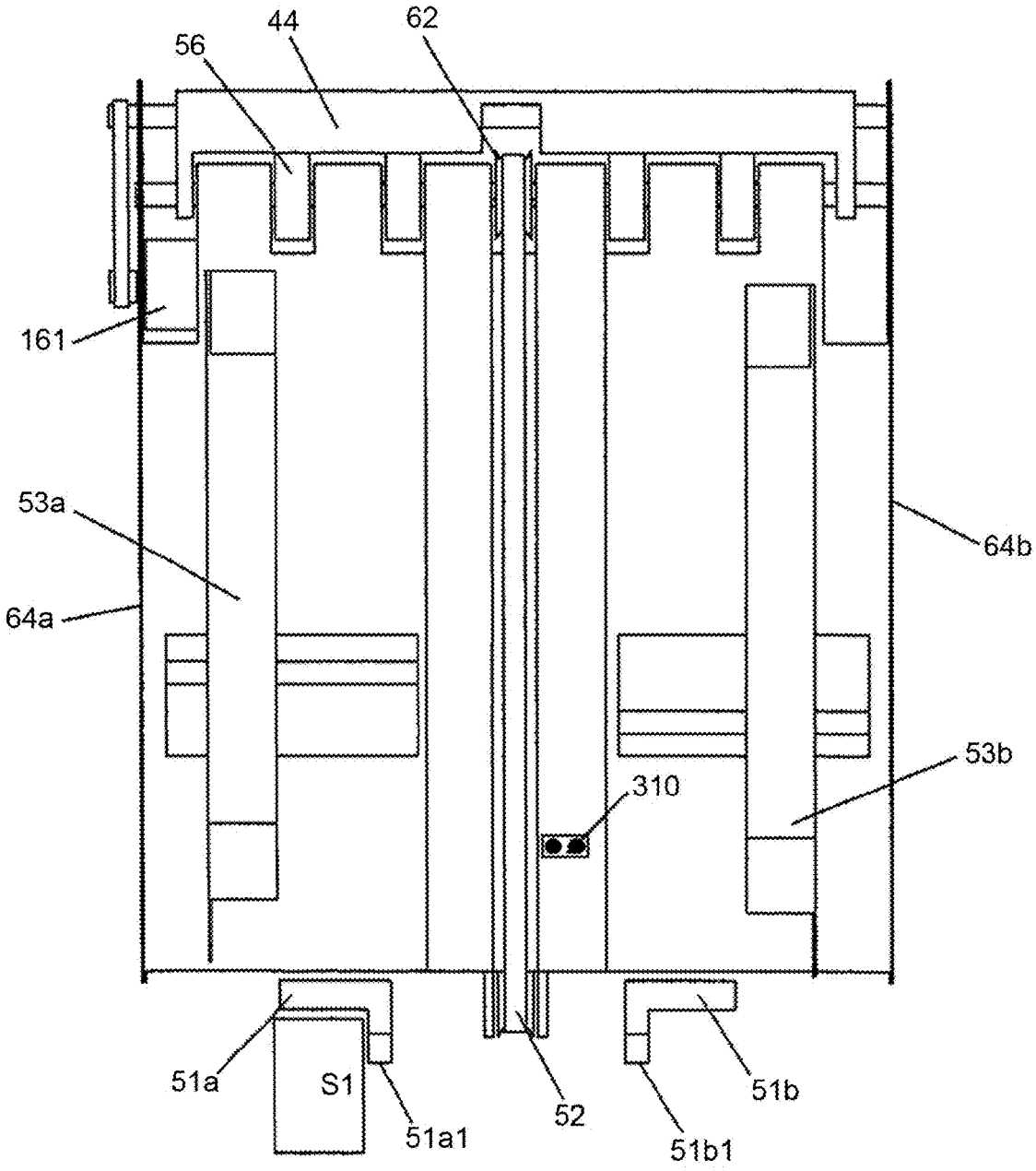
FIG. 2 is a schematic configuration diagram of a side-stitching tray illustrated in FIG. 1 as viewed from a sheet-stacking surface side of the tray.
Figure 4:
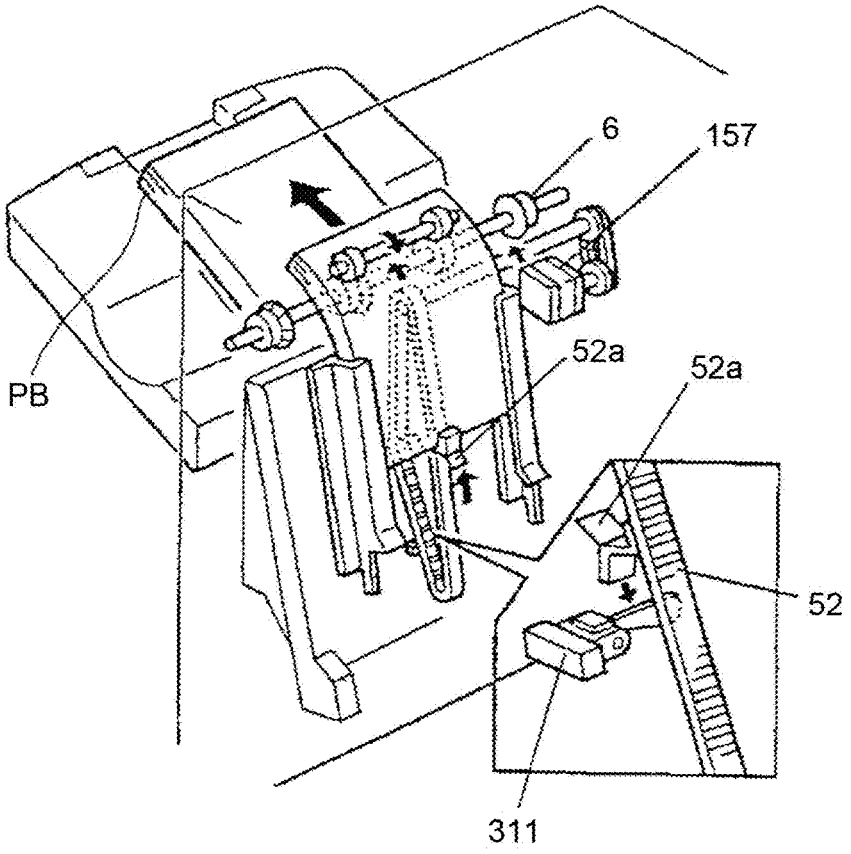
FIG. 4 is a perspective view illustrating an operation of an ejection belt illustrated in FIG. 1.

As illustrated in FIGS. 2 and 4, the ejection belt 52 is positioned at an alignment center in the sheet width direction, laid around pulleys 62 in a tensioned manner, and driven by an ejection-belt driving motor 157. A plurality of ejection rollers 56 are arranged to be symmetric with respect to the ejection belt 52 and rotatable relative to a drive shaft to function as driven rollers.

A home position (HP) of the ejection tabs 52*a* is detected by an ejection-belt HP sensor 311. The ejection-belt HP sensor 311 is turned on an off by the ejection tabs 52*a* provided on the ejection belt 52. The ejection tabs 52*a* are arranged on an outer circumferential surface of the ejection belt 52 at positions where the ejection tabs 52*a* face each other, and alternately move and convey the sheet bundle PB held in the side-stitching tray F. It is also possible to rotate the ejection belt 52 in reverse as required, thereby aligning leading ends of sheets of the sheet bundle PB in the conveying direction held in the side-stitching tray F against one of the ejection tabs 52*a* that is on standby to move the sheet bundle PB and a back surface of the other one of the ejection tabs 52*a*.

Referring to FIG. 1, a trailing-end holding lever 110 is arranged at a bottom end portion of the trailing-end reference fences 51 so that the trailing-end holding lever 110 can retain the trailing end of the sheet bundle PB held in the trailing-end reference fences 51. The trailing-end holding lever 110 reciprocates in a direction substantially orthogonal to the side-stitching tray F. Each sheet P that is output onto the side-stitching tray F is aligned by the tapping roller 12 in the longitudinal direction (sheet conveying direction); however, in a case where the trailing end of the sheet P placed on the side-stitching tray F is curled or possesses low stiffness, buckling and curling at the trailing end is likely to occur under its own weight. Moreover, the greater the number of stacked sheets, the smaller space is left in the trailing-end reference fences 51 to hold the next sheet therein, resulting in less favorable alignment in the longitudinal direction. A trailing-end holding mechanism is employed to reduce curling of a sheet trailing end PT and facilitate entry of the sheet P to the trailing-end reference fences 51. In this mechanism, the trailing-end holding lever 110 directly retains the sheet P or the sheet bundle PB.

In FIG. 1, reference numerals 302, 303, 304, 305, and 310 denote sheet detection sensors for detecting whether or not a sheet has passed by a position where the detection sensor is provided or presence/absence of a stacked sheet.

FIG. 2 is a schematic configuration diagram of the side-stitching tray F as viewed from a sheet-stacking surface side of the tray, or, in other words, as viewed from the right side of FIG. 1. Referring to FIG. 2, a sheet received from the image forming apparatus PR, which is on the upstream side, is aligned against jogger fences 53*a* and 53*b* in the sheet width direction, and aligned in the longitudinal direction by being abutted on trailing-end reference fences 51*a* and 51*b* (indicated by reference numeral 51 in FIG. 1). The trailing-end reference fences 51*a* and 51*b* include stack surfaces 51*a*1 and 51*b*1, respectively, that support the sheet trailing end PT in a two-point-support manner; that is, the sheet trailing end PT comes into contact with inner sides of the stack surfaces 51*a*1 and 51*b*1 to be held thereby. After completion of the alignment, the side-stitching stapler S1 performs stapling. As can be seen from the perspective view of FIG. 4 that illustrates an operation of the ejection belt, the ejection belt 52 is rotated counterclockwise by the ejection-belt driving motor 157, causing the trailing-end reference fences 51*a* and 51*b* to push up the stapled sheet bundle PB to a predetermined position. The sheet bundle PB is then lifted up by the ejection tab 52*a* attached to the ejection belt 52 and ejected from the side-stitching tray F. Reference numerals 64*a* and 64*b* denote a front side plate and a back side plate, respectively. An operation similar to this operation can be performed on a not-stapled sheet bundle, on which stapling is not performed after the alignment.

Figure 3:
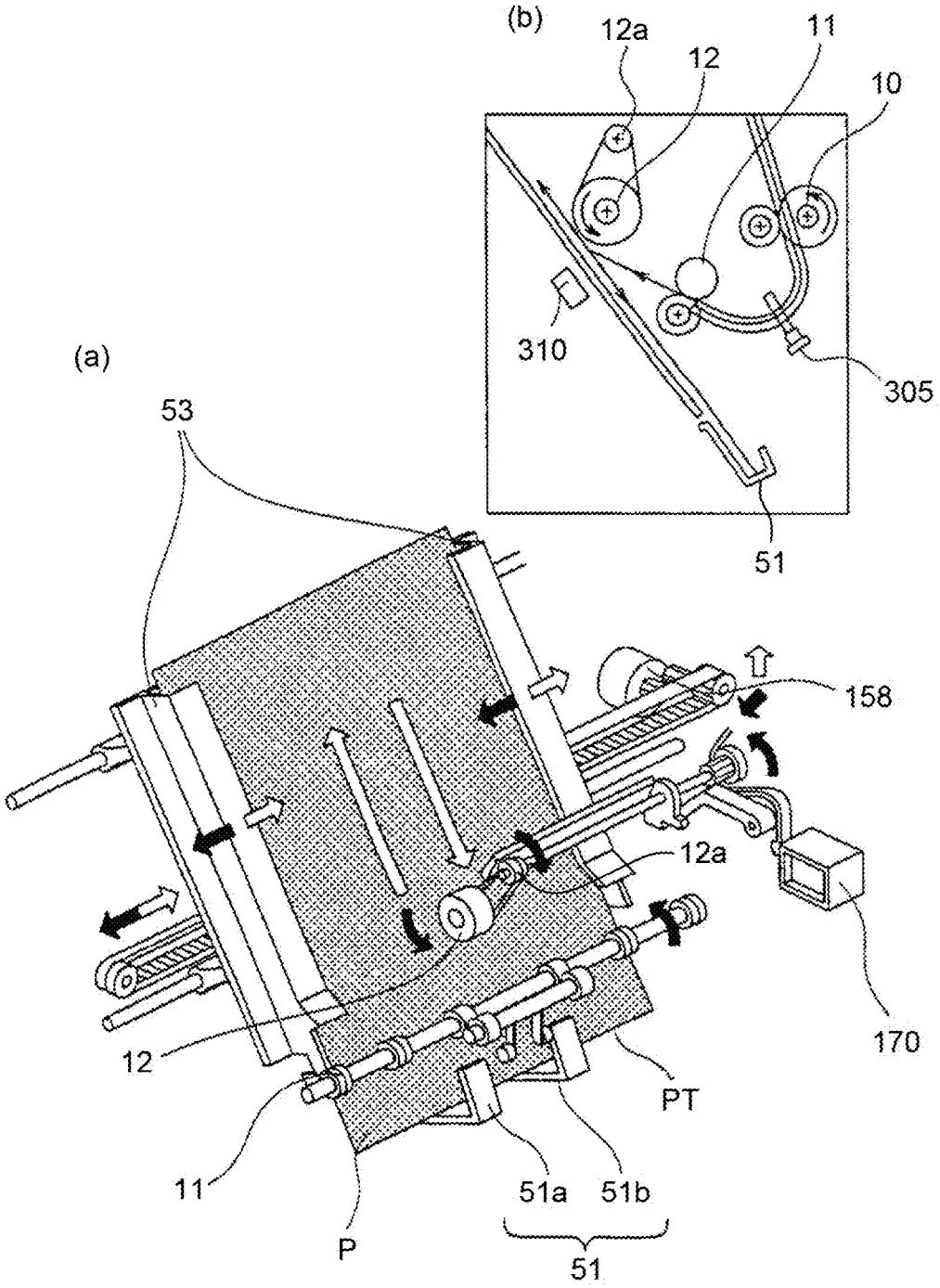
FIG. 3(*a*) is a perspective view illustrating a schematic configuration of the side-stitching tray and a mechanism annexed thereto and FIG. 3(*b*) is a side view of a relevant portion of the side-stitching tray and a mechanism annexed thereto.

FIG. 3(*a*) is a perspective view illustrating a schematic configuration of the side-stitching tray F and a mechanism annexed thereto, and FIG. 3(*b*) is a side view of a relevant portion of the side-stitching tray and a mechanism annexed thereto. As illustrated in FIGS. 3(*a*) and 3(*b*), the sheet P conveyed by the sheet-stapling output rollers 11 to the side-stitching tray F is sequentially stacked on the side-stitching tray F. At this time, when the number of the sheets P output onto the side-stitching tray F is one, sheet alignment is performed on each sheet in the longitudinal direction (sheet conveying direction) between the tapping roller 12 and the trailing-end reference fences 51, and also sheet alignment is performed in the width direction (sheet width direction perpendicular to the sheet conveying direction) against the jogger fences 53*a* and 53*b*. The tapping roller 12 is driven to swing on a fulcrum 12*a* by a tapping solenoid (SOL) 170. Thus, the tapping roller 12 intermittently acts on the sheet output onto the side-stitching tray F, thereby causing the sheet trailing end PT to abut on the trailing-end reference fences 51. Meanwhile, the tapping roller 12 rotates counterclockwise in FIGS. 3(*a*) and 3(*b*). As illustrated in FIGS. 2 and 3(*a*), the pair of jogger fences 53 (53*a* and 53*b*) are arranged on opposite sides across the width of sheets. A jogger motor 158 that can rotate forward and backward drives the pair of jogger fences 53 via a timing belt to thereby move the jogger fences 53 in a reciprocating manner toward and away from each other symmetrically in the sheet width direction.

Referring back to FIG. 1, a sheet-bundle redirecting mechanism is arranged downstream of the side-stitching tray F in the sheet conveying direction. A conveying path for conveying the sheet bundle PB from the side-stitching tray F to the saddle-stitching tray G and from the side-stitching tray F to the shift tray 202 and a conveying unit that conveys the sheet bundle PB are made up of a conveying mechanism 35 that applies a conveying force to the sheet bundle PB, the ejection rollers 56 that turn the sheet bundle PB, and the guide member 44 that guides the sheet bundle PB to turn the sheet bundle PB.

Configurations of these elements are described in detail below. The conveying mechanism 35 includes a drive shaft 37 and a roller 36, to which a driving force of the drive shaft 37 is transmitted via a timing belt. The roller 36 and the drive shaft 37 are connected and supported by an arm in such a manner that the roller 36 can pivot about the drive shaft 37 serving as a fulcrum. The roller 36 of the conveying mechanism 35 is driven to pivot by a cam 40. The cam 40 is rotated about a rotary shaft by a motor (not shown). In the conveying mechanism 35, a driven roller 42 is arranged at a position where the driven roller 42 faces the roller 36. A conveying force is applied to the sheet bundle PB by pinching the sheet bundle PB between the driven roller 42 and the roller 36 and pressing the sheet bundle PB with an elastic member.

The conveying path along which the sheet bundle PB is turned from the side-stitching tray F to the saddle-stitching tray G is formed between the ejection rollers 56 and an inner surface of the guide member 44 on the side where the guide member 44 faces the ejection rollers 56. The guide member 44 is driven to pivot about a fulcrum on a driving force transmitted to the guide member 44 from a bundle-route-switch driving motor 161 (see FIG. 2). To convey the sheet bundle PB from the side-stitching tray F to the shift tray 202, the guide member 44 pivots clockwise in FIG. 1 about the fulcrum so that space between an outer surface (the surface on the side where the guide member 44 does not face the ejection rollers 56) of the guide member 44 and a guide plate on the outer side of the outer surface functions as a conveying path. To convey the sheet bundle PB from the side-stitching tray F to the saddle-stitching tray G, the ejection tab 52*a* pushes up the trailing end of the sheet bundle PB aligned on the side-stitching tray F. The roller 36 of the conveying mechanism 35 and the driven roller 42 facing the roller 36 pinch the sheet bundle PB therebetween to apply the conveying force to the sheet bundle PB. Before pinching the sheet bundle PB, the roller 36 of the conveying mechanism 35 is on standby at a position where the roller 36 does not contact the leading end of the sheet bundle PB. After the leading end of the sheet bundle PB has passed by the roller 36 of the conveying mechanism 35, the roller 36 is brought into contact with the sheet surface to apply the conveying force to the sheet bundle PB. Simultaneously, the guide member 44 and the ejection rollers 56 form a guide for a turn conveyance path to convey the sheet bundle PB downstream to the saddle-stitching tray G.

As illustrated in FIG. 1, the saddle-stitching tray G is arranged downstream from the sheet-bundle redirecting mechanism that includes the conveying mechanism 35, the guide member 44, and the ejection rollers 56. The saddle-stitching tray G is arranged downstream of the sheet-bundle redirecting mechanism in a substantially upright position. The saddle-stitching tray G includes a center folding mechanism at a center portion of the saddle-stitching tray G, and an upper bundle-conveyance guide plate 92 and a lower bundle-conveyance guide plate 91 above and below the center folding mechanism, respectively.

Upper bundle conveying rollers 71 and lower bundle conveying rollers 72 are arranged in an upper portion and a lower portion of the upper bundle-conveyance guide plate 92, respectively. The saddle-stitching upper jogger fences 250*a* are arranged along side surfaces of the upper bundle-conveyance guide plate 92 in a manner to straddle the rollers 71 and 72. Similarly, the saddle-stitching lower jogger fences 250*b* are provided along side surfaces of the lower bundle-conveyance guide plate 91. The saddle-stitching stapler S2 is arranged at a position where the saddle-stitching lower jogger fences 250*b* are provided. The saddle-stitching upper jogger fences 250*a* and the saddle-stitching lower jogger fences 250*b* are driven by a driving mechanism (not shown) and perform alignment in the direction (sheet width direction) perpendicular to the sheet conveyance direction. The saddle-stitching stapler S2 includes two stapler units that are spaced from each other a predetermined distance in the sheet width direction. Each stapler unit includes a pair of a clincher unit and a driving unit.

A movable trailing-end reference fence 73 extends across the lower bundle-conveyance guide plate 91. moving mechanism including a timing belt and a drive mechanism for the timing belt allows the movable trailing-end reference fence 73 to move in the sheet conveying direction (i.e., the vertical direction in FIG. 1). As illustrated in FIG. 1, the drive mechanism includes a drive pulley and a driven pulley, between and around which the timing belt is laid, and a stepping motor that drives the drive pulley. Similarly, a trailing-end tapping member 251 and a drive mechanism therefor are arranged at a top end of the upper bundle-conveyance guide plate 92. The trailing-end tapping member 251 is driven by the drive mechanism (not shown) via a timing belt 252 to move in a reciprocating manner in a direction away from the sheet-bundle redirecting mechanism and a direction in which the trailing-end tapping member 251 pushes the trailing end (i.e., the downstream end of the sheet bundle PB conveyed onto the saddle-stitching tray G) of the sheet bundle PB.

The center folding mechanism positioned at a substantially center portion of the saddle-stitching tray G includes the folding plate 74, the folding rollers 81, and the conveying path H along which the folded sheet bundle PB is conveyed. Referring to FIG. 1, an HP sensor 326 detects a home position of the trailing-end tapping member 251; a crease passage sensor 323 detects a center-folded sheet; a bundle detection sensor 321 detects arrival of the sheet bundle PB at a center-folding position; a movable-trailing-end-reference-fence HP sensor 322 detects a home position of the movable trailing-end reference fence 73.

In the present embodiment, a detection lever 501 for detecting a stack height of the center-folded sheet bundle PB is arranged on the lower tray 203 to be pivotable on a fulcrum 501*a*. A sheet level sensor 505 detects an angle of the detection lever 501. An ascending/descending motion and tray-full of the lower tray 203 are detected based on the detected angle.

Figure 5:
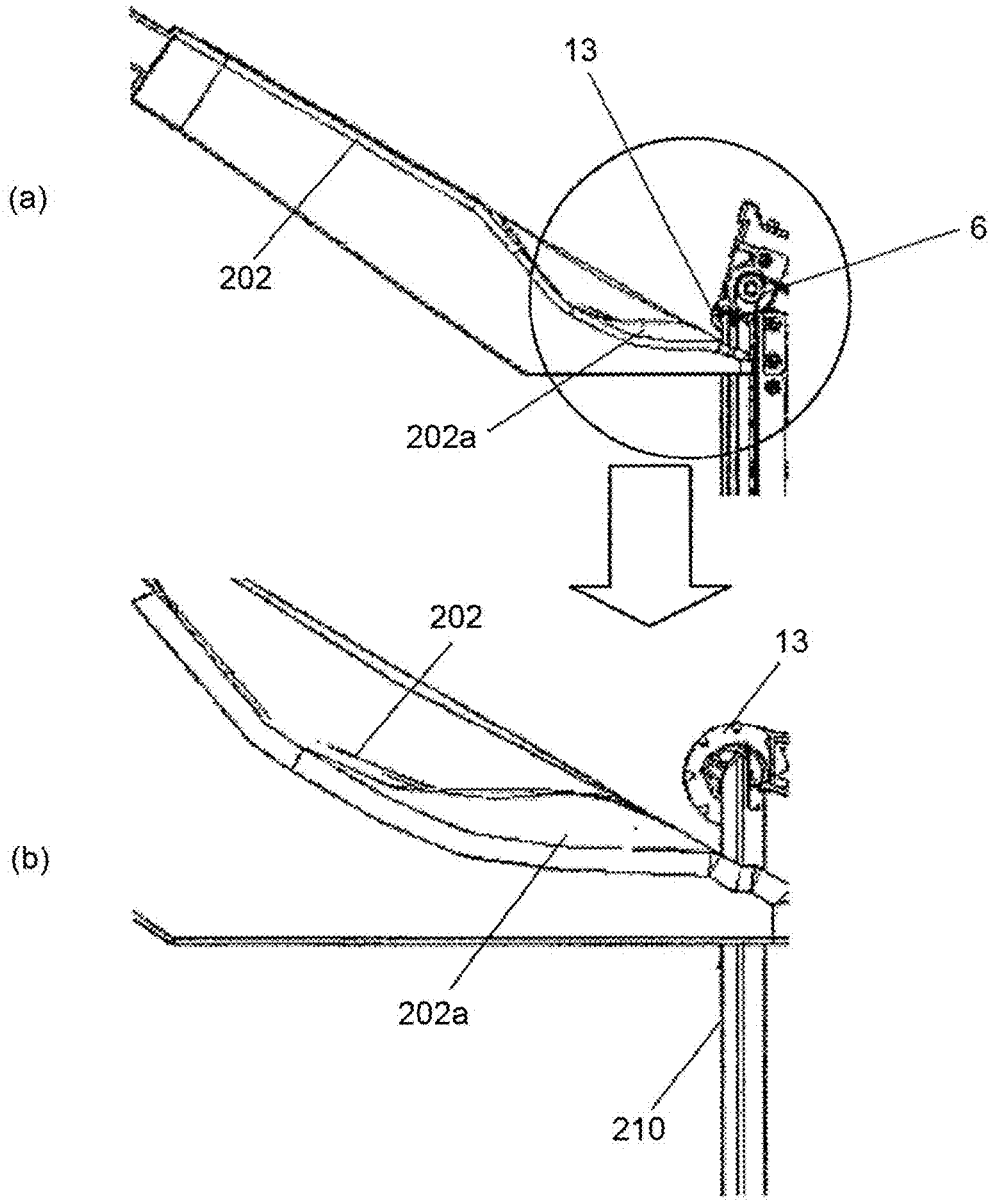
FIG. 5(*a*) is a front view of a relevant portion of a shift tray illustrated in FIG. 1 on standby, and FIG. 5(*b*) an enlarged front view of the relevant portion of the shift tray illustrated in FIG. 5(*a*)

FIG. 5 is a front view of a relevant portion of a sheet output unit of the shift tray 202. FIG. 5(*a*) is a diagram illustrating a sheet-output standby state. FIG. 5(*b*) is an enlarged view of the circled portion of FIG. 5(*a*). As described above, sheets are conveyed via the pairs of sheet output rollers 6 (6*a* and 6*b*) to the shift tray 202 where sheet sorting is performed. The sheet sorting is performed as described above using the pairs of shift sheet-output rollers 6 (6*a* and 6*b*), the return roller 13, the shift tray 202, the shift mechanism, and the shift-tray elevating mechanism.

Figure 6:
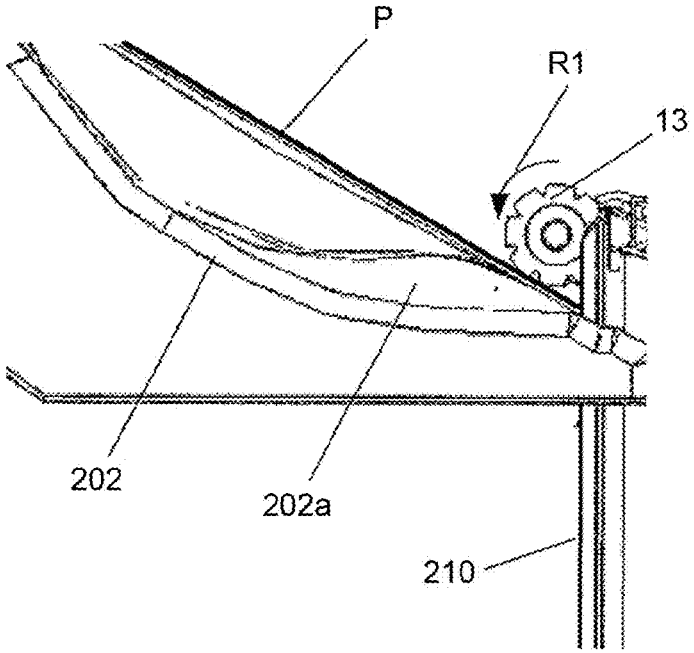
FIG. 6 is an explanatory diagram of an alignment operation in a sheet conveying direction on the shift tray.

FIG. 6 is an explanatory diagram of an alignment operation in the sheet conveying direction. The alignment operation is performed in such a manner that, after the sheet P is output, the return roller 13 comes into contact with the sheet P while rotating in the direction (direction indicated by arrow R1) in which the sheet P moves back toward an end fence 210, thereby deliberately moving the sheet P back toward the end fence 210. The return roller 13 is driven by a return-roller driving motor 223, which is not shown but will be described later. A driving force generated by the return-roller driving motor 223 is transmitted to the return roller 13 via a timing belt 13*a* (see FIG. 12).

Figure 7:
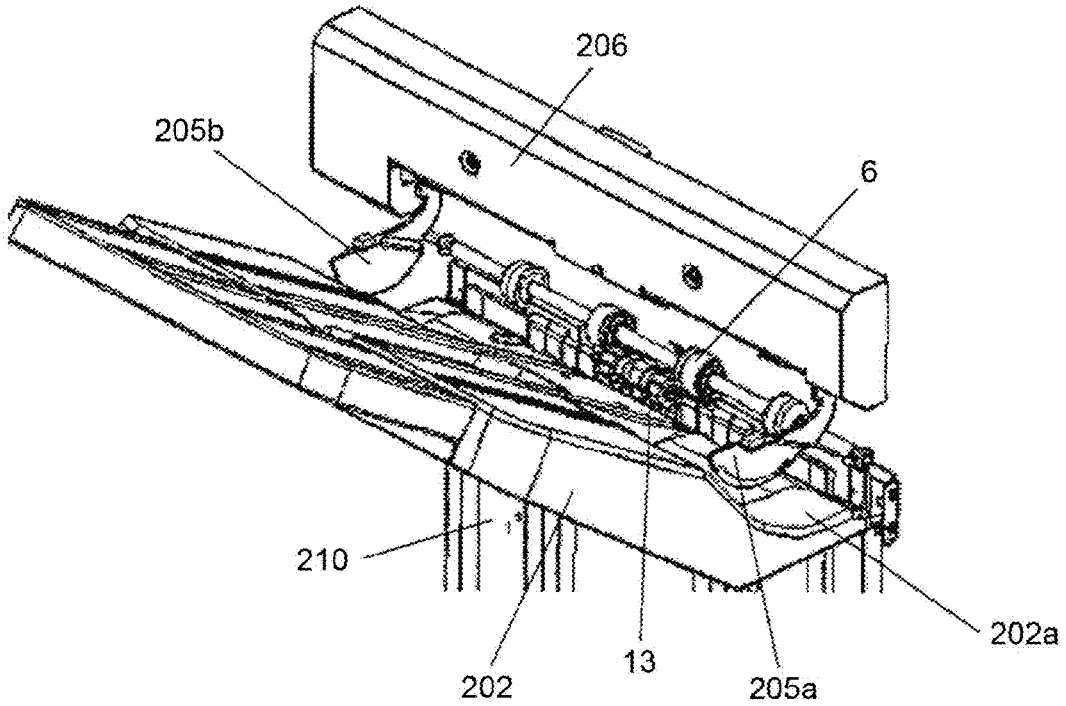
FIG. 7 is a perspective view of a sheet output unit including the shift tray and sheet output rollers.

FIG. 7 is a perspective view of the sheet output unit that includes the shift tray and the sheet output rollers. As illustrated in FIG. 7, a pair of joggers 205*a* and 205*b* that aligns the sheet P in the width direction on the shift tray 202 are arranged above the shift tray 202. The joggers 205*a* and 205*b* are movable in the width direction of the sheet P by being driven by a jogger driving mechanism 206. The jogger driving mechanism 206 has a known structure and its mechanism does not have direct bearing on the present invention; accordingly, detailed description about the jogger driving mechanism 206 is omitted. In FIG. 5 and other drawings, reference numeral 202*a* denotes a recess provided to permit the joggers 205*a* and 205*b* to move.

Figure 8:
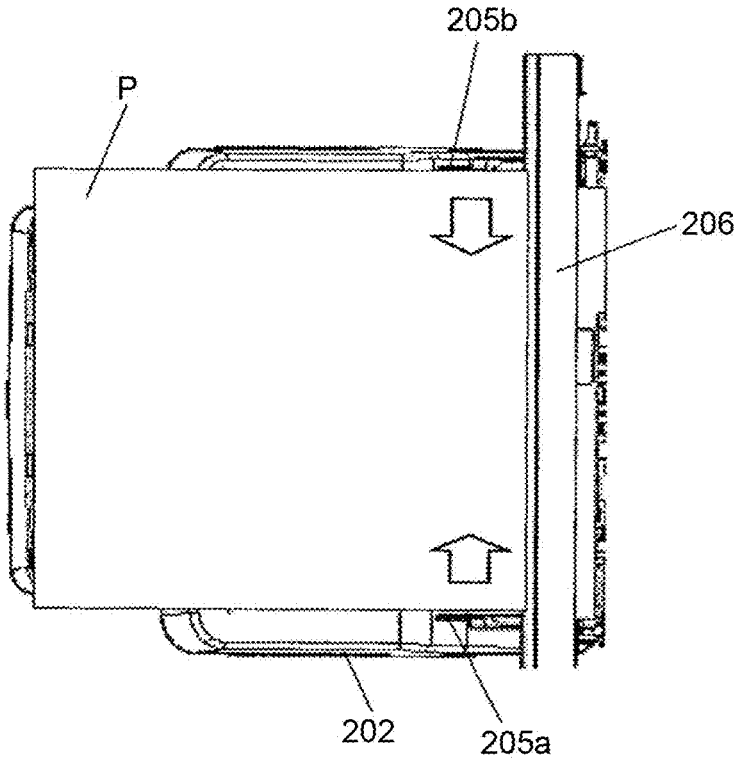
FIG. 8 is a diagram illustrating an alignment operation in a sheet width direction on the shift tray.
Figure 9:
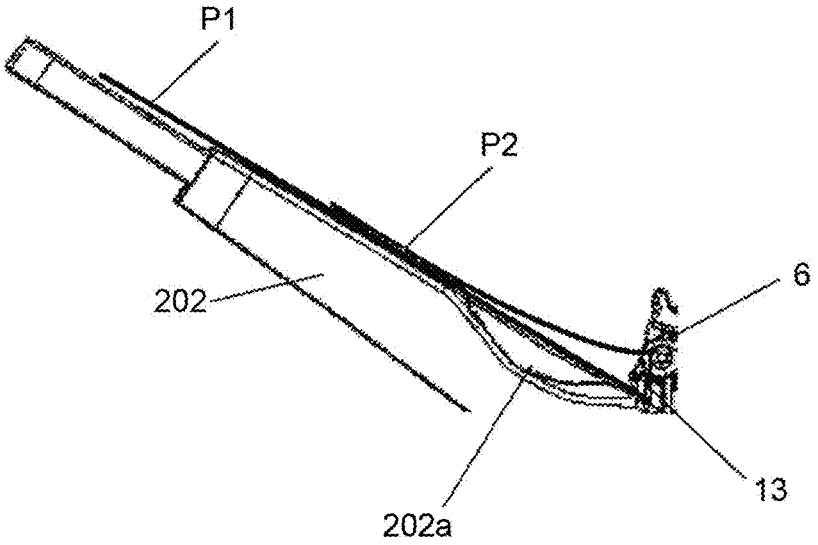
FIG. 9 is a diagram illustrating the shift tray in a state where a following sheet is output onto the shift tray where a preceding sheet is already placed.
Figure 10:
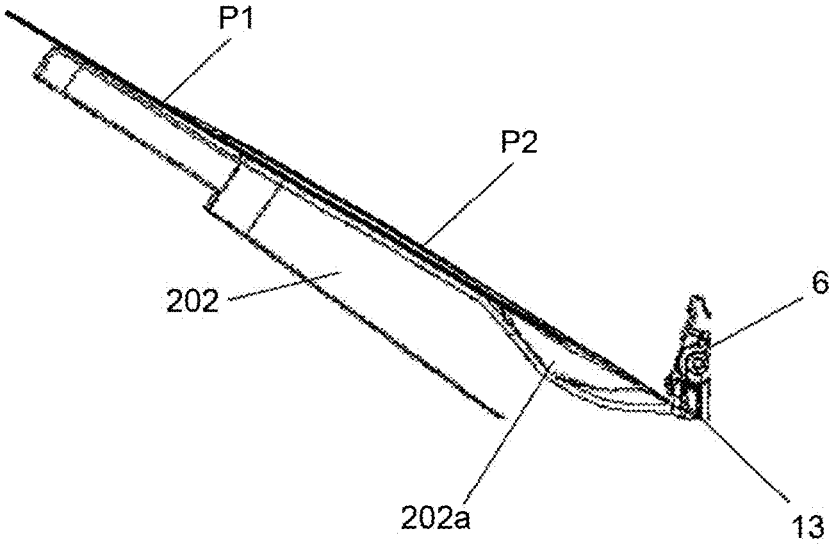
FIG. 10 is a diagram illustrating the shift tray in a state, continued from the state illustrated in FIG. 9, where sheet clinging occurs due to close contact between the sheets and the following sheet pushes out the preceding sheet.

FIG. 8 is a diagram illustrating an alignment operation in the sheet width direction on the shift tray 202. After the sheet P has been output, the jogger 205*a* on one side in the sheet width direction and the jogger 205*b* on the other side align the sheet P in the width direction by sandwiching the sheet P therebetween. However, in a case where the sheet P has high smoothness as does coated paper, when a subsequent sheet P2 is output onto the shift tray 202 where a preceding sheet P1 is already placed as illustrated in FIG. 9, sheet clinging can occur due to close contact between the sheets. As a result, the subsequent sheet P2 that is in contact with the preceding sheet P1 can undesirably push out the preceding sheet P1 as illustrated in FIG. 10.

To prevent the preceding sheet P1 from being pushed out in this manner, in the present embodiment, the sheet output unit includes air blowers. The air blowers blow air to between the preceding sheet P1 and the subsequent sheet P2 when the subsequent sheet P2 is output, thereby preventing the subsequent sheet P2 from clinging to the preceding sheet P1.

Figure 11:
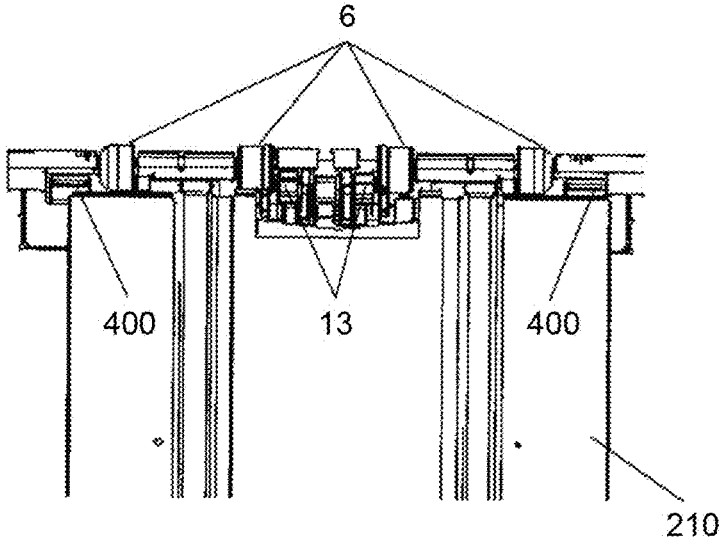
FIG. 11 is a front view of a relevant portion of the sheet output unit illustrated in FIG. 1 for illustration of the structure of the sheet output unit.
Figure 12:
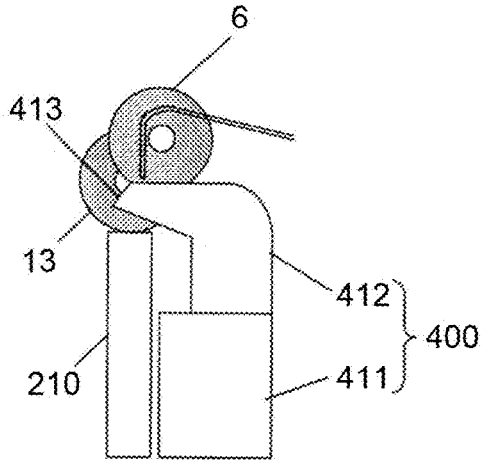
FIG. 12 is an enlarged cross-sectional view of the relevant portion as viewed from the right side of FIG. 11.

FIG. 11 is a front view of a relevant portion of the sheet output unit that includes air blowers according to the present embodiment for illustration of the structure of the sheet output unit. FIG. 12 is an enlarged cross-sectional view of the relevant portion as viewed from the right side of FIG. 11. Referring to FIGS. 11 and 12, a pair of air blowers 400 are arranged on widthwise outer sides of the four pairs of sheet output rollers 6 arranged in the sheet width direction. As illustrated in FIG. 12, each of the air blowers 400 includes a blower fan 411 and an air-blow guide 412. The blower fan 411 is driven by a motor (not shown) and supplies airflow from a blowing nozzle 413 of the air-blow guide 412 at an air velocity that depends on the rotation speed of the motor. The sheet output unit includes the two air blowers 400 in the present embodiment; however, as a matter of course, the sheet output unit may include three or more air blowers to be adaptable to wide-format sheets, for example.

The blowing nozzle 413 is open at a level lower than the pairs of sheet output rollers 6 and higher than the shift tray 202 as illustrated in FIG. 12. This configuration makes it possible to supply airflow to between a top surface of the shift tray 202 and a sheet output from the pairs of sheet output rollers 6. Air blowing is performed by driving the motor that drives the blower fan 411 in principle. The CPU 101 of the sheet postprocessing apparatus PD controls driving of the motor. More specifically, the CPU 101 of the sheet postprocessing apparatus PD determines whether or not to blow air based on sheet information fed from the image forming apparatus PR, and causes the motor to rotate so that air blowing is performed.

Figure 13:
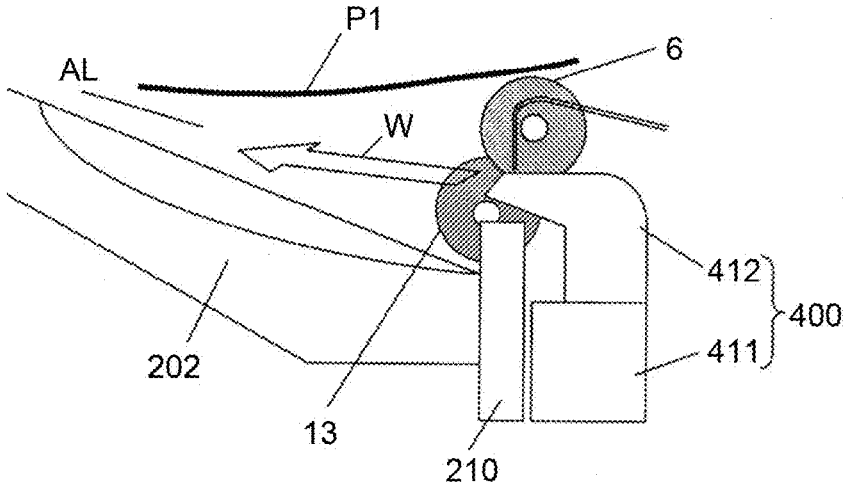
FIG. 13 is an explanatory diagram of an operation of an air blower illustrated in FIG. 12 and illustrating a state where the first sheet is being output.
Figure 14:
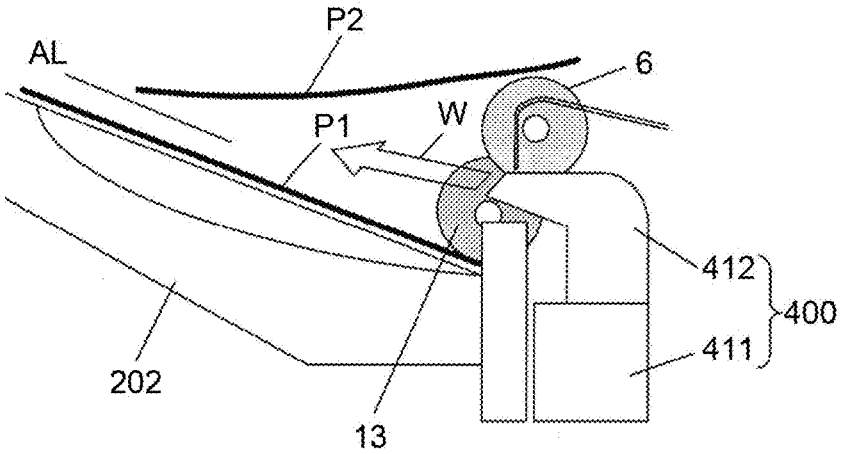
FIG. 14 is an explanatory diagram of the operation of the air blower illustrated in FIG. 12 and illustrating a state where the second sheet is being output.

FIGS. 13 and 14 are explanatory diagrams illustrating operations of the air blower 400. As illustrated in FIG. 13, when the sheet P1 is output onto the shift tray 202, the blower fan 411 of the air blower 400 is driven to supply airflow W to a back-surface side of the sheet P1. This air blowing operation forms a layer of air AL between the shift tray 202 and the sheet P1. When the sheet P1 that has fallen onto the shift tray 202 while pushing out the air layer AL is moved to a position underneath the return roller 13, the sheet P1 is conveyed by the return roller 13 in the direction opposite to the conveying direction. The trailing end of the sheet P1 abuts on the end fence 210 to be aligned in the sheet conveying direction.

Subsequently, the joggers 205*a* and 205*b* perform sheet alignment in the sheet width direction. Also when the subsequent sheet P2 is brought into contact with the preceding sheet P1 as illustrated in FIG. 14 after completion of the sheet alignment in the conveying direction and the width direction, the air blower 400 is driven to supply the airflow W to a back-surface side of the subsequent sheet P2. As a result, the air layer AL is formed between the preceding sheet P1 and the subsequent sheet P2, and close contact between the sheets is prevented or reduced.

When performing the air blowing, the CPU 101 of the sheet postprocessing apparatus PD receives sheet information from the image forming apparatus PR and performs adjustment to an optimum airflow rate according to the sheet information. The sheet information includes paper-type information indicating ordinary paper, coated paper, tracing paper, or the like, paper-thickness information indicating thick paper, thin paper, or the like, and sheet-size information indicating A3, A4, B4, or the like. Accordingly, adjustment to an airflow rate that is optimum for preventing sheet clinging is performed based on the sheet information including information about paper type, paper thickness, and sheet size transmitted from the image forming apparatus PR when the airflow W is to be supplied to between the preceding sheet P1 and the subsequent sheet P2 as illustrated in FIG. 14, so that the air layer AL extends to the entire sheet surface.

Figure 15:
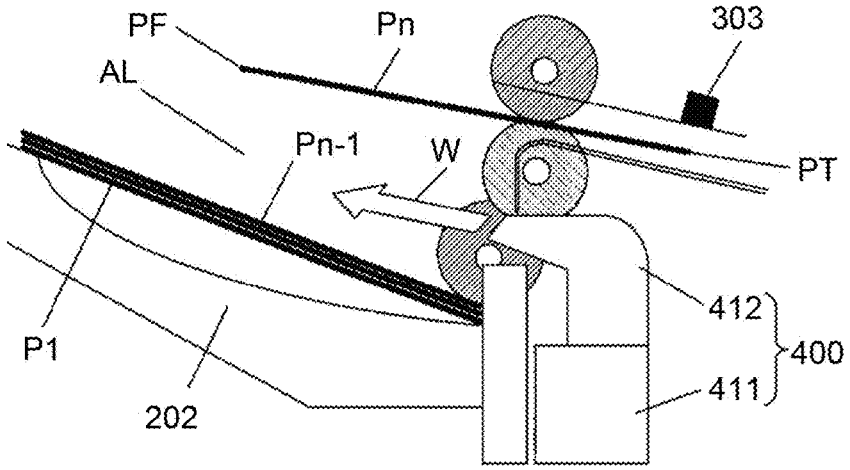
FIG. 15 is an explanatory diagram illustrating a sheet output state and air blowing timing in a situation in which air blowing is started.
Figure 16:
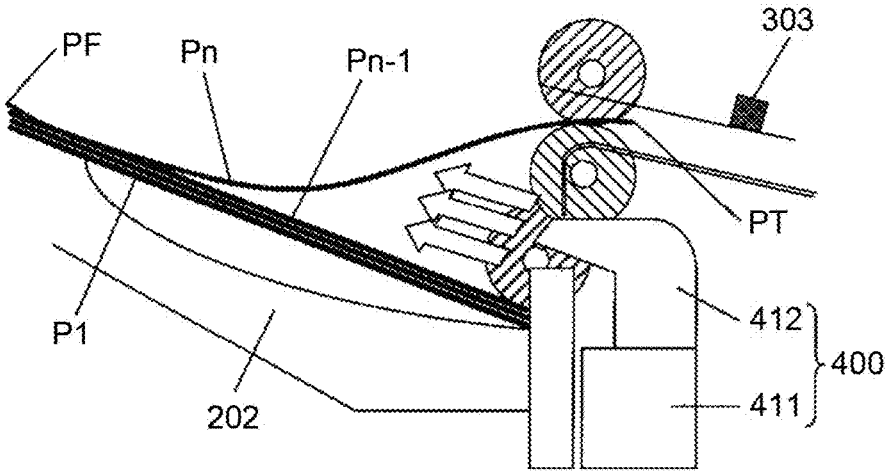
FIG. 16 is an explanatory diagram illustrating a sheet output state and air blowing timing in a situation in which the air blowing is stopped.

FIGS. 15 and 16 are explanatory diagrams illustrating sheet output states and air blowing timing. FIG. 15 illustrates a situation in which air blowing is started; FIG. 16 illustrates a situation in which the airflow rate is increased. In the present embodiment, an amount of the sheet that is output is determined based on time elapsed since the sheet detection sensor 303 has detected a sheet leading end PF. For example, air blowing starts after lapse of Δta seconds since the sheet detection sensor 303 has detected the sheet leading end PF. In addition, the airflow rate starts increasing after lapse of Δtb seconds since the start of the air blowing as illustrated in FIG. 16. In addition, the air blowing is stopped after lapse of Δtc seconds (preset timing after the sheet trailing end PT has exited the pairs of sheet output rollers 6) since the sheet trailing end PT has passed by the sheet detection sensor 303. As described above, a series of steps including starting the air blowing, increasing the airflow rate, and stopping the air blowing is performed on each sheet. As a result, clinging between sheets can be reduced. Moreover, adjustment to an optimum airflow rate can be performed based on information about paper type, paper thickness, and sheet size fed from the image forming apparatus PR when outputting the sheet. Control for these is performed by the CPU 101, which will be described later.

In FIGS. 15 and 16, reference numeral and symbol Pn and Pn−1 denote the last sheet and a next previous sheet of the last sheet, respectively, of a sheet stack of n sheets.

Figure 17:
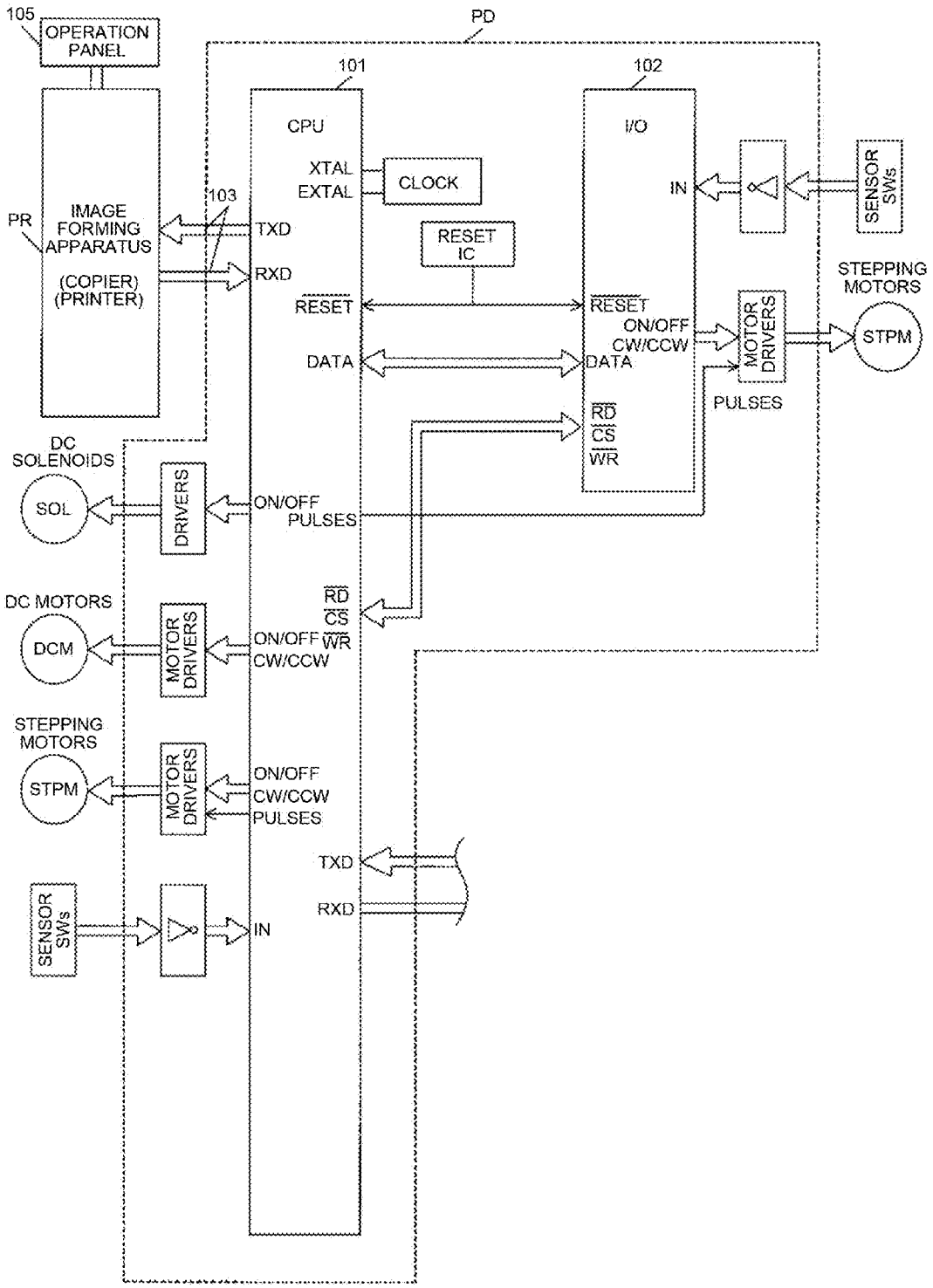
FIG. 17 is a block diagram illustrating a control configuration of an image forming system including the sheet postprocessing apparatus and the image forming apparatus.

FIG. 17 is a block diagram illustrating a control configuration of the image forming system including the sheet postprocessing apparatus PD and the image forming apparatus PR. The sheet postprocessing apparatus PD includes a control circuit on which a microcomputer including the CPU 101 and an I/O interface 102 is mounted. The CPU 101 receives signals from a CPU of the image forming apparatus PR, switches of an operation panel 105, and sensors (not shown) via a communication interface 103. The CPU 101 performs predetermined control in accordance with the input signals. Moreover, the CPU 101 controls and drives solenoids and motors via drivers and motor drivers, and acquires sensor information from sensors in the apparatus via the interface. Moreover, the CPU 101 controls and drives motors using motors drivers via the I/O interface 102 according to an entity to be controlled and sensors, and acquires sensor information from the sensors. The above-described control is performed in accordance with program defined by program codes stored in a ROM (not shown). The CPU 101 reads out the program codes and loads them into a RAM (not shown), and executes the program defined by the program codes while using the RAM as a working area and a data buffer.

Figure 19:
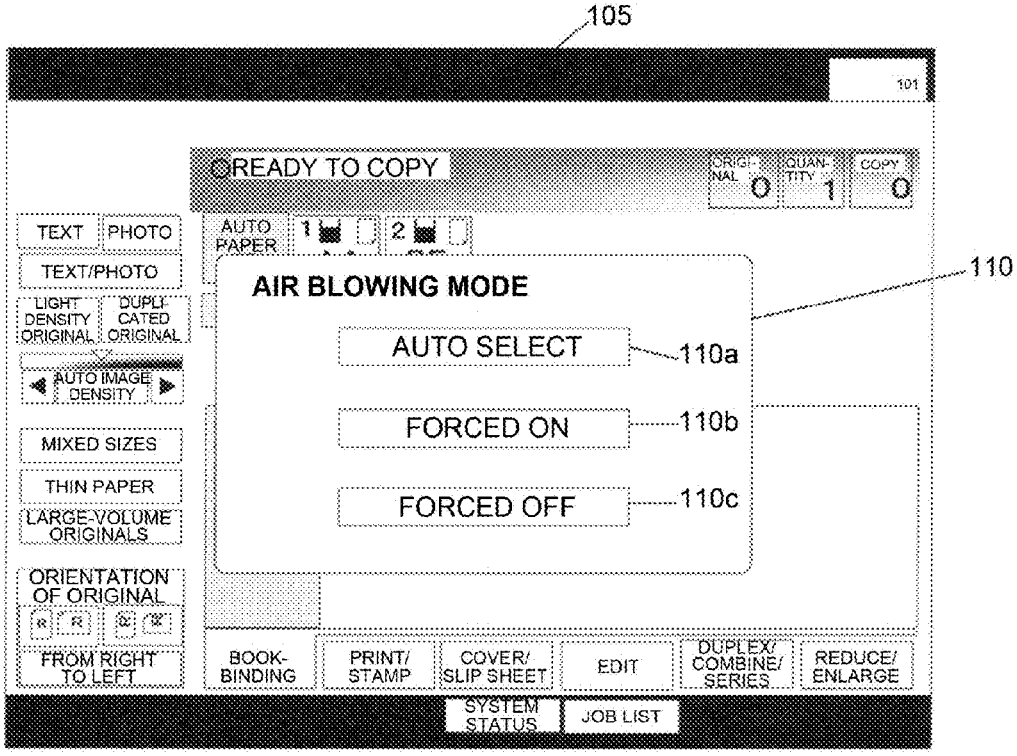
FIG. 19 is a front view illustrating a selection screen that appears on an operation panel of the image forming apparatus when an air blowing mode is selected.
Figure 20:
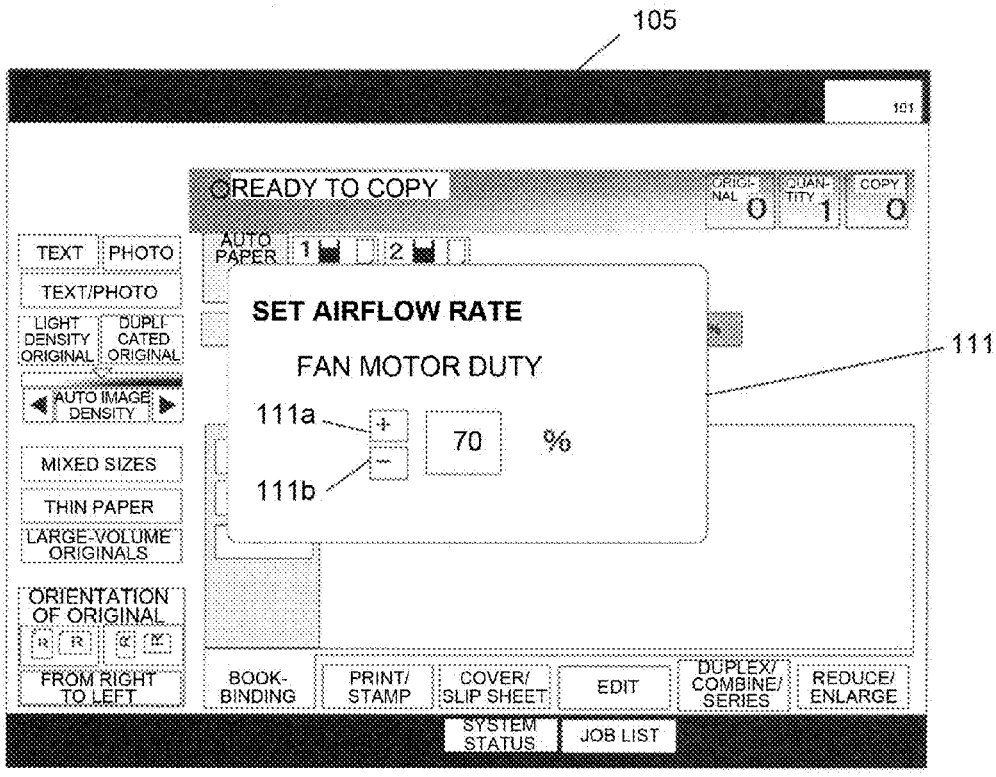
FIG. 20 is a front view illustrating an airflow-rate setting screen.

FIG. 13 is a flowchart of a procedure for air blowing operation control according to the present embodiment. FIG. 19 is a front view illustrating a selection screen that appears on the operation panel of the image forming apparatus when an air blowing mode is selected. FIG. 20 is a front view illustrating an airflow-rate setting screen.

When the air blowing mode is selected, an auto select key 110*a*, a forced ON key 110*b*, and a forced OFF key 110*c* are displayed on a selection screen 110 for the air blowing mode as illustrated in FIG. 19. A function is selectable by touching an area where a key corresponding to the function is displayed. When the auto select key 110*a* is touched and the automatic selection is selected, settings are automatically configured so as to cause the air blowers 400 to blow air when coated paper is selected in paper type setting. When the forced ON key 110*b* or the forced OFF key 110*c* is selected, it becomes possible to configure settings as to whether or not to blow air, which is independent of paper type.

FIG. 20 illustrates an example of the airflow-rate setting screen displayed on the operation panel of the image forming apparatus. The airflow rate is automatically adjusted to an optimum airflow rate based on sheet information (about paper type, paper thickness, and sheet size) fed from the image forming apparatus PR. FIG. 21 illustrates an airflow-rate setting screen 111 in a situation in which a duty factor of the fan motor that drives the fan of the air blower 400 is set to 70%. A default airflow rate is adjustable from this screen by increasing or decreasing the airflow rate by touching an increment button 111*a* or a decrement button 111*b*.

Figure 18:
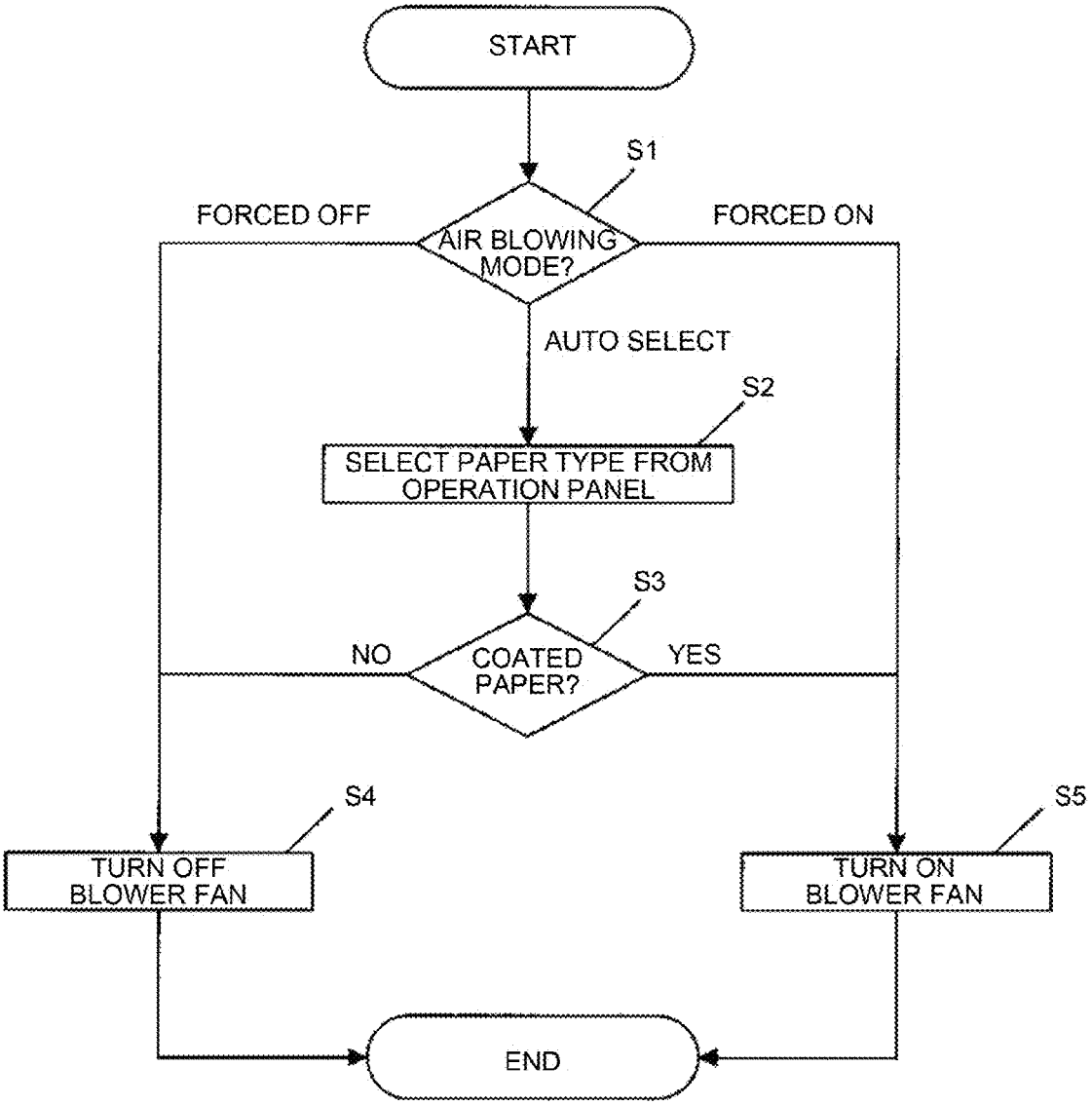
FIG. 18 is a flowchart illustrating a procedure for air blowing operation control.

Referring to FIG. 18, when the air blowing operation control is started, which air blowing mode has been selected is determined first (Step S1). Which air blowing mode has been selected is determined based on a touch selection made from the selection screen 110 on the operation panel 105 of the image forming apparatus PR as illustrated in FIG. 19. When a user touches the auto select key 110*a* and further selects a paper type from the operation panel 105 (Step S2), whether or not the selected paper type is coated paper is determined (Step S3).

When the selected paper type is not coated paper in Step S3, the blower fan 411 is turned off (Step S4); whereas when the selected paper type is coated paper, the blower fan 411 is turned on (Step S5), and the procedure ends. In the latter case, the airflow rate is automatically adjusted to an optimum airflow rate based on sheet information input from the image forming apparatus PR.

When it is determined in Step S1 that the forced OFF key 110*c* has been selected, the blower fan 411 is turned off (Step S4), and the procedure ends. On the other hand, when it is determined in Step S1 that the forced ON key 110*b* has been selected, the blower fan 411 is turned on (Step S5), and the procedure ends.

Each process in the flowchart illustrated in FIG. 18 is performed by the CPU 101.

Close contact between sheets can be reduced by controlling air blowing timing and the airflow rate of the air blower 400 as described above. As a result, it is possible to prevent sheet buckling or sheet clinging, thereby obtaining favorable alignment accuracy.

As described above, the present embodiment offers the following advantages.

1) The sheet postprocessing apparatus includes: the pairs of sheet output rollers 6 that output the sheet P; the shift tray 202 on which the sheet P output by the pairs of sheet output rollers 6 is to be stacked; the air blowers 400 that blow air onto the sheet P output by the pairs of sheet output rollers 6; and the CPU 101 that controls when the air blowers 400 should start and stop air blowing and the airflow rate according to an amount of the sheet P output from the pairs of sheet output rollers 6. Accordingly, when to start and stop air blowing and the airflow rate are controlled according to an output sheet amount on an output-sheet-by-output-sheet basis. As a result, favorable alignment accuracy can be obtained because fluttering of the sheet leading end PF is prevented and, moreover, buckling or clinging of the sheet P is prevented.

2) Air blowing starts when the output sheet amount of the sheet P reaches a preset first output sheet amount. For example, air blowing starts after lapse of Δta seconds since the sheet detection sensor 303 has detected the sheet leading end PF. Accordingly, fluttering of the sheet leading end can be reduced.

3) The airflow rate is increased when the output sheet amount of the sheet P, which is an amount of the sheet P that is output since start of the air blowing, reaches a preset second output sheet amount. For example, the airflow rate is increased after lapse of Δtb seconds since start of the air blowing. Accordingly, it becomes possible to reduce fluttering of the sheet leading end PF consecutively from 2), thereby preventing buckling or clinging of the sheet P.

4) Air blowing is stopped after the sheet P has been output from the pairs of sheet output rollers 6. For example, the air blowing is stopped after lapse of Δtc seconds since the sheet trailing end PT has passed by the sheet detection sensor 303. Accordingly, it becomes possible to prevent buckling or clinging of the sheet P, thereby obtaining favorable alignment accuracy.

5) The airflow rate of the air blower 400 is controlled and adjusted based on sheet information. Accordingly, it becomes possible to set an appropriate airflow rate that allows preventing fluttering of the sheet leading end and sheet buckling or clinging and obtaining favorable alignment accuracy based on type, thickness, or size of the sheet.

6) An initial value of the airflow rate can be input by operating the selection screen 110 on the operation panel 105. Accordingly, not only automatic processing becomes possible, but also manual setting by a user to an appropriate airflow rate is allowed.

The sheet in the appended claims is denoted by P; the sheet output unit corresponds to the pairs of sheet output rollers 6; the tray unit corresponds to the shift tray 202; the air blower unit corresponds to the air blower 400; the control unit corresponds to the CPU 101; the first output sheet amount corresponds to an amount of the sheet output during a period of Δta seconds since the sheet detection sensor 303 has detected the sheet leading end PF; the second output sheet amount corresponds to an amount of the sheet output during a period of Δtb seconds since the start of the air blowing, which is started after lapse of Δta seconds since the sheet detection sensor 303 has detected the sheet leading end PF; the airflow-rate setting unit corresponds to the selection screen 110 on the operation panel 105; the sheet processing apparatus corresponds to the sheet postprocessing apparatus PD; and the image forming system corresponds to the system that includes the image forming apparatus PR and the sheet postprocessing apparatus PD.

According to an aspect of the present invention, fluttering of a leading end of a sheet does not occur even when air is blown onto the sheet, and favorable alignment accuracy can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet output device comprising:

a sheet output unit configured to output a sheet;

a tray unit on which the sheet output by the sheet output unit is to be stacked;

an air blower unit configured to blow air onto the sheet output by the sheet output unit;

a control unit configured to control an airflow rate of the air blower unit according to an output sheet amount, the output sheet amount being an amount of the sheet output from the sheet output unit; and an airflow-rate setting unit configured to allow inputting an initial value of the airflow rate by operating an operation unit.

2. The sheet output device according to claim 1, wherein the control unit causes air blowing to start when the output sheet amount reaches a preset first output sheet amount.

3. The sheet output device according to claim 2, wherein the control unit causes the airflow rate to increase when the output sheet amount, the output sheet amount being an amount of the sheet that is output since start of the air blowing, reaches a preset second output sheet amount.

4. The sheet output device according to claim 1, wherein the control unit causes the air blowing to stop after the sheet has been output from the sheet output unit.

5. The sheet output device according to claim 1, wherein the control unit controls and adjusts the airflow rate based on sheet information.

6. A sheet processing apparatus comprising the sheet output device according to claim 1.

7. An image forming system comprising the sheet output device according to claim 1.

8. A sheet output method comprising:

outputting, by a sheet output unit, a sheet conveyed to the sheet output unit;

stacking the sheet output by the sheet output unit on a tray unit;

blowing air, by an air blower unit, the blowing air including starting air blowing, stopping the air blowing, and changing an airflow rate according to an amount of the sheet output from the sheet output unit; and allowing inputting of an initial value of the airflow rate by operating an operation unit.

9. A sheet output device comprising:

a sheet output unit configured to output a sheet;

a tray unit on which the sheet output by the sheet output unit is to be stacked;

an air blower unit configured to blow air onto the sheet output by the sheet output unit; and a control unit configured to control an airflow rate of the air blower unit according to an output sheet amount, the output sheet amount being an amount of the sheet output from the sheet output unit, wherein the control unit causes air blowing to start when the output sheet amount reaches a preset first output sheet amount and causes the airflow rate to increase when the output sheet amount, the output sheet amount being an amount of the sheet that is output since start of the air blowing, reaches a preset second output sheet amount.

10. A sheet processing apparatus comprising the sheet output device according to claim 9.

11. An image forming system comprising the sheet output device according to claim 9.

* * * * *